US011905729B2

(12) United States Patent
Zastrow

(10) Patent No.: US 11,905,729 B2
(45) Date of Patent: Feb. 20, 2024

(54) MECHANICALLY ASSISTED RETRACTABLE NESTED-PANEL VEHICLE STRUCTURE WITH DRAINAGE AND MOISTURE ABATEMENT STRATEGIES

(71) Applicant: Steven Alan Zastrow, Viroqua, WI (US)

(72) Inventor: Steven Alan Zastrow, Viroqua, WI (US)

( * ) Notice: Subject to any disclaimer, the term of this patent is extended or adjusted under 35 U.S.C. 154(b) by 9 days.

(21) Appl. No.: 17/817,526

(22) Filed: Aug. 4, 2022

(65) Prior Publication Data

US 2023/0038590 A1 Feb. 9, 2023

Related U.S. Application Data

(60) Provisional application No. 63/203,915, filed on Aug. 4, 2021.

(51) Int. Cl.
*E04H 6/04* (2006.01)
*E04B 1/344* (2006.01)
*E04B 1/343* (2006.01)

(52) U.S. Cl.
CPC ..... *E04H 6/04* (2013.01); *E04B 1/3448* (2013.01); *E04B 1/34305* (2013.01)

(58) Field of Classification Search
CPC .. E04H 6/02; E04H 6/04; E04H 15/38; E04B 1/3448; E04B 1/343; E06B 3/921
See application file for complete search history.

(56) References Cited

U.S. PATENT DOCUMENTS 2,742,674 A * 4/1956 Melder ..... E04H 6/02 52/64
3,949,528 A * 4/1976 Hartger ..... E04H 6/005 D25/4
4,306,390 A * 12/1981 Brown ..... A63G 25/00 52/DIG. 14
4,800,701 A * 1/1989 Dunsworth ..... E04H 6/005 52/143
5,740,828 A * 4/1998 Evans ..... E04H 6/04 135/132
5,746,237 A 5/1998 Arnic
6,052,951 A * 4/2000 Daoud ..... E04B 1/3448 52/64
6,349,732 B1 2/2002 Cooper
6,802,327 B2 10/2004 Koss
7,013,904 B2 3/2006 Kofler
7,051,481 B2 5/2006 Delavega et al.
7,096,628 B2 8/2006 Millward
(Continued)

FOREIGN PATENT DOCUMENTS

FR 870081 A * 3/1942
GB 2399574 A * 9/2004 ..... E04H 6/005

*Primary Examiner* — Christine T Cajilig
(74) *Attorney, Agent, or Firm* — Dunlap Bennett & Ludwig, PLLC

(57) ABSTRACT

A shelter has a rear stationary portion and a front retractable door, both on a base. The retractable door comprises nesting arcuate-roofed panels that cooperate to form an enclosing dome-like structure when closed. Moisture drainage and abatement strategies assist in keeping the shelter usable for long periods in exposed environments. Mechanical spring-biased assistance aids in both opening and closing the nested panels, resulting in a shelter that is easy to deploy and suitable for long term use.

4 Claims, 4 Drawing Sheets

(56) References Cited

U.S. PATENT DOCUMENTS

| | | | | |
|---|---|---|---|---|
| 7,210,492 | B2 | 5/2007 | Gerrie et al. | |
| 7,644,544 | B2 | 1/2010 | Kea, Jr. et al. | |
| 8,171,947 | B2 | 5/2012 | Hardie | |
| 8,267,106 | B2 | 9/2012 | Jordache et al. | |
| 8,967,172 | B2 | 3/2015 | Ying | |
| 10,286,969 | B2 | 5/2019 | Srabstein | |
| 2005/0155299 | A1 | 7/2005 | Alspaugh | |
| 2007/0022670 | A1* | 2/2007 | Herter | E04H 6/005 52/79.1 |
| 2008/0210284 | A1 | 9/2008 | Dubois | |
| 2008/0313970 | A1 | 12/2008 | Turcot | |
| 2017/0107738 | A1* | 4/2017 | Sprung | E04H 15/18 |
| 2019/0106902 | A1 | 4/2019 | Irizarry | |
| 2023/0012113 | A1* | 1/2023 | Pearson | B62J 19/00 |
| 2023/0013342 | A1* | 1/2023 | Keeble | B60L 53/30 |

* cited by examiner

MECHANICALLY ASSISTED RETRACTABLE NESTED-PANEL VEHICLE STRUCTURE WITH DRAINAGE AND MOISTURE ABATEMENT STRATEGIES

CROSS-REFERENCE TO RELATED APPLICATION

This application claims the benefit of U.S. Provisional Patent App. No. 63/203,915, filed Aug. 4, 2021, the entirety of which is hereby incorporated by reference.

BACKGROUND OF THE INVENTION

Retractable shells with panel segments for covering vehicles are known. For example, U.S. Published Appl. No. 2019/0106902 discloses an automatically retractable vehicle cover. The collapsible cover is rotatably connected to a mounting bracket by powered shafts. The mechanism may be actuated to automatically retract and deploy, for example with a remote control and powered motors. Rotating panels provide a semi-circular shape in the closed position. This published application does not disclose any technique or system to aid in manual retraction or deployment. U.S. Pat. No. 5,740,828 discloses a collapsible dome structure for use as a shelter. Sections nest within each other when collapsed. A gasket helps seal the unit from ambient moisture. This patent also does not disclose any technique or system to aid in manual retraction or deployment.

What is needed is a manually deployable and retractable nesting paneled shelter that has provision for aiding manual deployment and retraction. What is further needed is a shelter with moisture abatement strategies more sophisticated than a mere gasket. What is also needed is a shelter that contains spacing strategies allowing for auxiliary storage outside a main storage area.

It is an object of the present invention to address these and other deficiencies in the prior art, which persons of skill in the art would appreciate from the detailed disclosure herein.

SUMMARY OF THE INVENTION

In summary, a nesting door shelter, comprises a base comprising a front and a rear; a rear stationary portion at the rear of the base, comprising side walls, a rear wall and a roof; a front nesting panel door, comprising at least two nesting panels and connectably engaged to the rear stationary portion; and at least one lever in biased engagement with at least one nesting panel and configured to bias the at least one nesting panel toward a closed position, whereby stored potential energy aids in manual collapse and deployment of the front nesting panel door.

DETAILED DESCRIPTION

The illustrations and drawings herein are for the purpose of describing embodiments and versions of the present invention and are not intended to limit the scope of the present invention.

Figure 1:
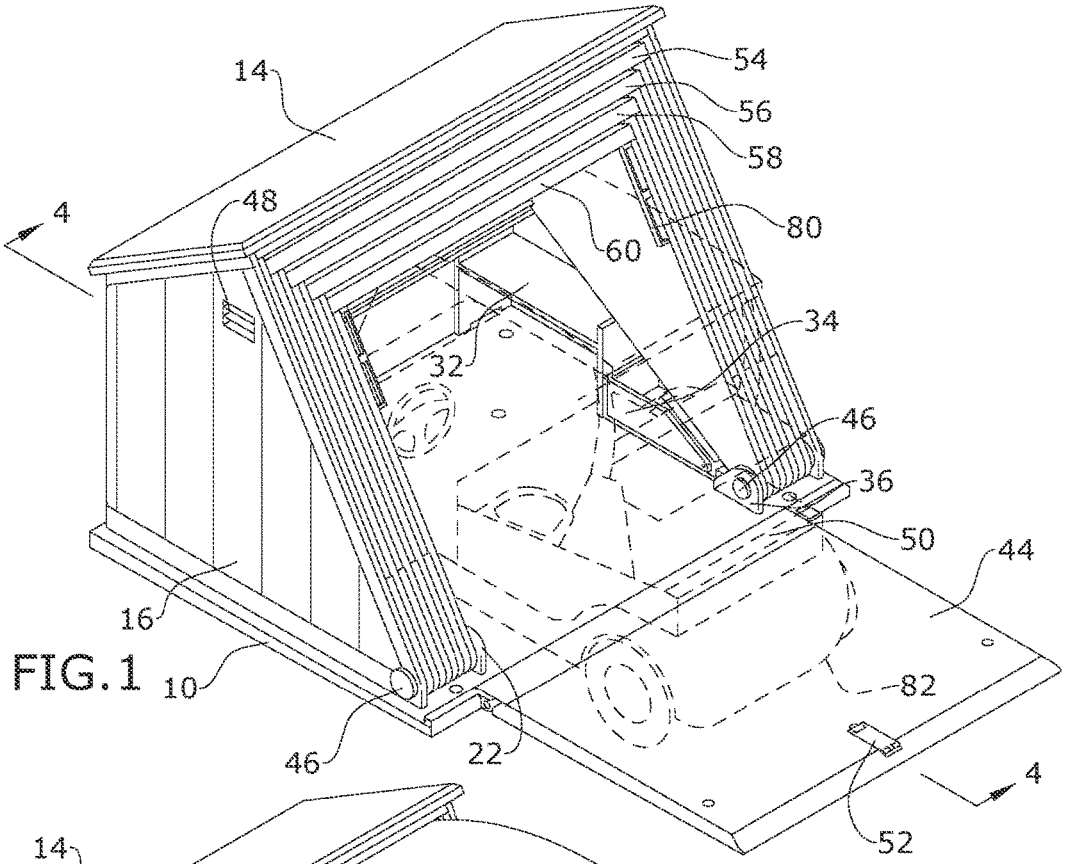
FIG. 1 is a perspective view of the shelter of the present invention open.
Figure 2:
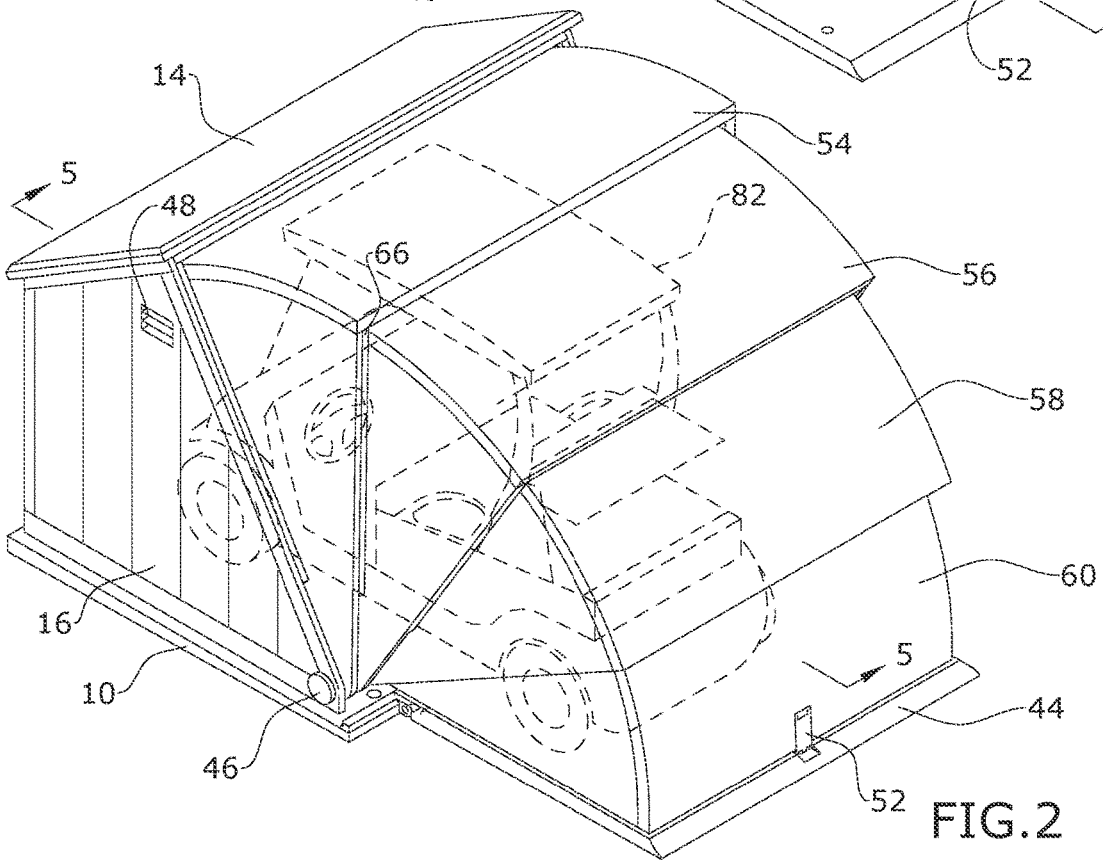
FIG. 2 is a perspective view of the invention closed.

FIGS. 1-7 generally show the shelter structure herein. Referring to FIG. 1, an open configuration of an embodiment of a nesting paneled shelter is shown, and referring to FIG. 3, an exploded view of that shelter is shown. The shelter's enclosing structure generally rests on base 10, resting on the ground. There is a stationary back wall 12, a stationary roof 14, a stationary left wall 16 and a stationary right wall 30, each of which is disposed rearward of the shelter's opening and pivoting base 44. In use, when the shelter is retracted and open, a small vehicle such as a golf cart 82 or a tractor (not shown) can be wheeled into the shelter, whereupon the shelter might be deployed and closed (FIG. 2). Alternatively, when the shelter is retracted and empty, the pivoting base 44 may be tilted up to place the shelter in a compact storage position, allowing the shelter to be moved easily to a different location (not shown). A filler panel 50 assists in sealing the enclosure, to cover otherwise open hinge areas of pivoting base 44.

Figure 3:
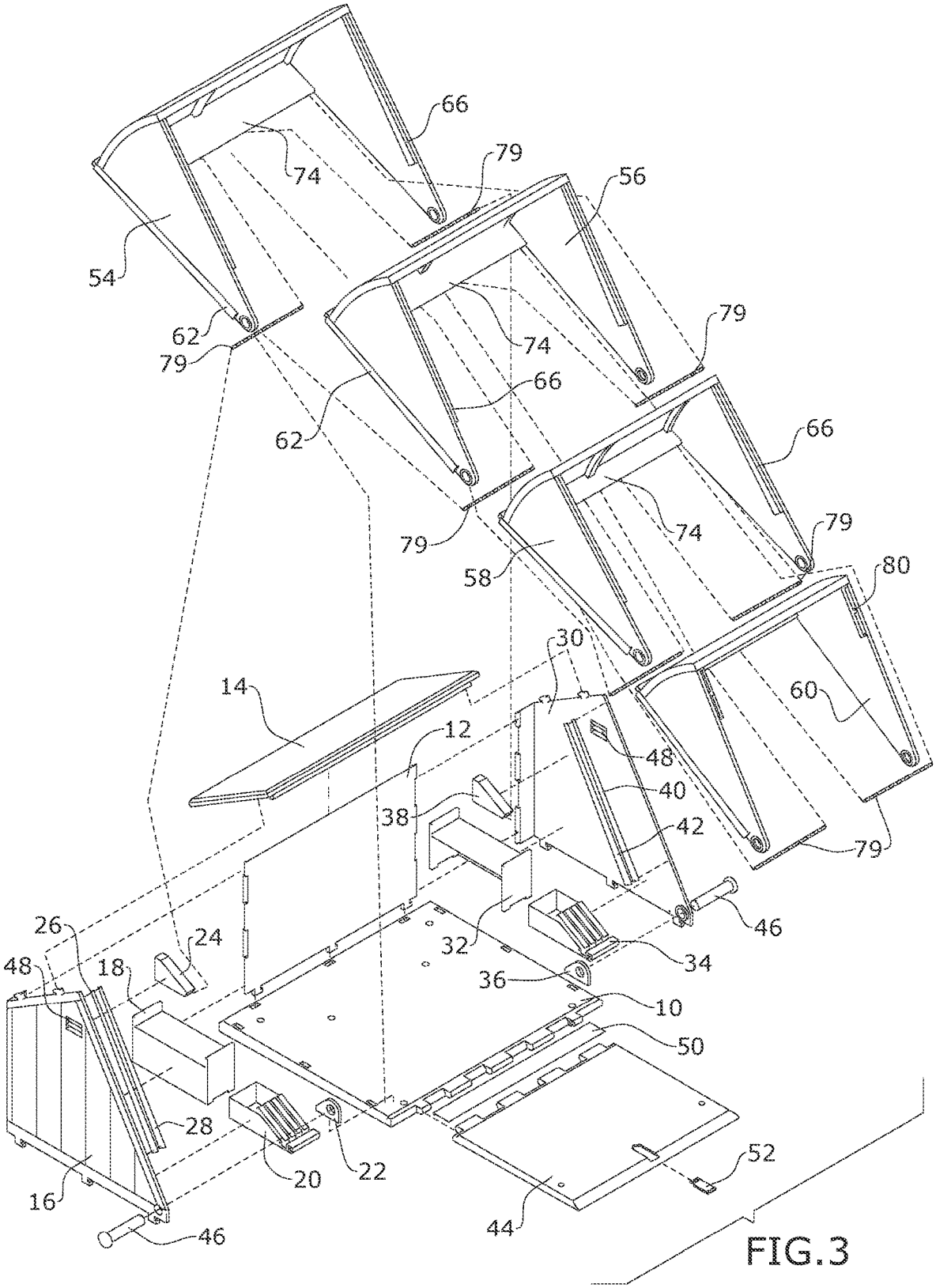
FIG. 3 is an exploded view of the invention.
Figure 4:
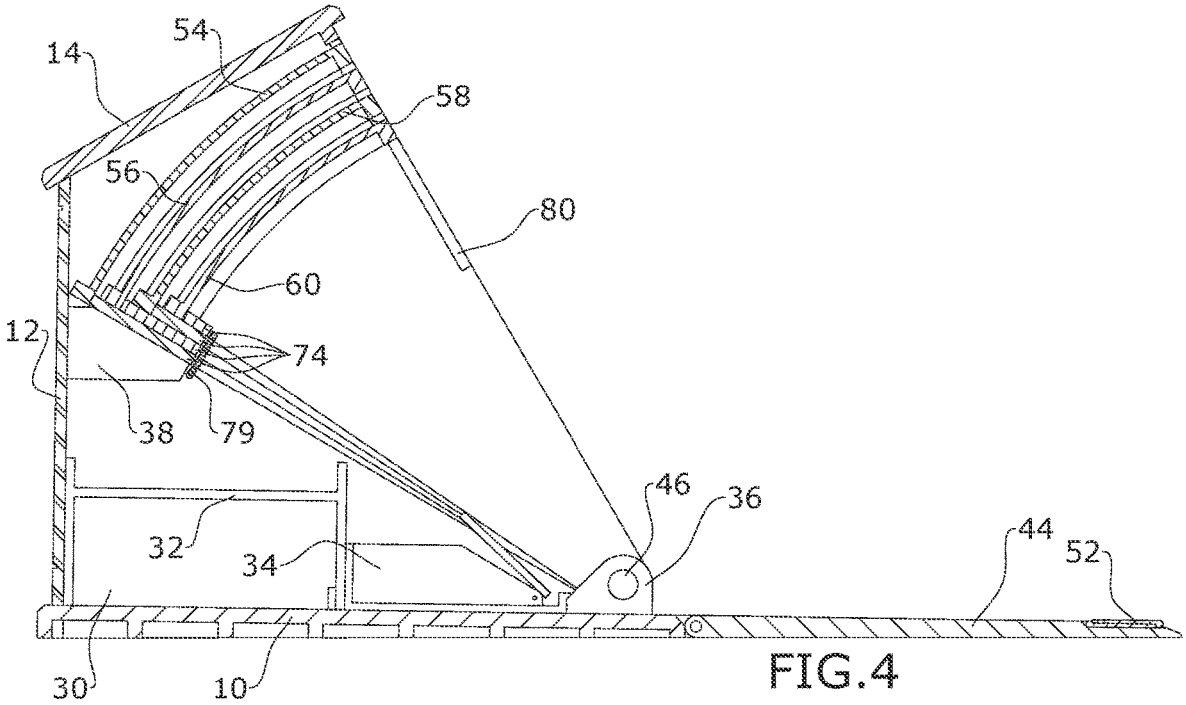
FIG. 4 is a section view of the invention, taken along line 4-4 in FIG. 1.
Figure 5:
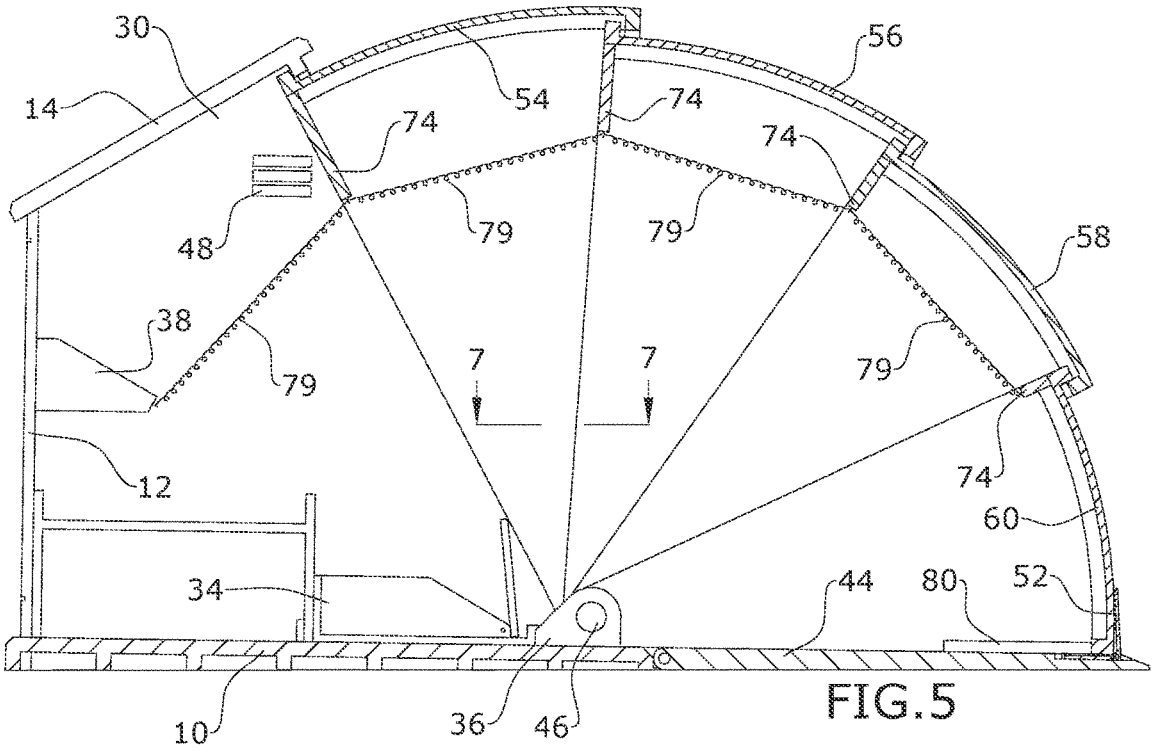
FIG. 5 is a section view of the invention, taken along line 5-5 in FIG. 2.

Arcuate pivoting sections 54, 56, 58 and 60 perform a nesting operation during retraction, and an unnesting operation during deployment. FIG. 2 depicts the shelter in a deployed, closed position, whereupon hasp 52 may be engaged to lock the shelter, e.g., with a padlock (not shown). Left pivot support 22 and right pivot support 36 are fastened or otherwise molded or welded to base 10, and support pivot pins 46, which rotatably engage and affix in place the bottom parts of arcuate pivoting sections 54, 56, 58 and 60 through holes (preferably grommeted). As shown in FIG. 3, pivot pins 46 engage through respective stationary walls 16 and 30. At least outer arcuate pivoting sections 54 and 56 contain side gutters 62 with side gutter lips 64, to divert and drain rainwater toward the outer bottom of the shelter, such as around the entry point to pivot pins 46. Each of arcuate pivoting sections 54, 56 and 58 also contains a roof support 74, stabilizing and supporting the nesting operation when the panels are retracted (as in FIG. 4, where they rest against one another).

Left side folding section assisting assembly 20 and right side folding section assisting assembly 34 are essentially identical, and comprise pivoting levers (or fingers) held in tension by torsion springs (not shown), one lever for each pivoting section. Of course, levers that differ in size may also be appropriate, to accommodate varying strengths and angles of torsion springs for differently sized pivoting sections. Such torsion springs store potential energy during retraction, and release it during deployment. Each assembly 20, 34 will push against and spring bias a rear back part of its respective pivoting section, particularly the bottom rearmost edge as it approaches the location of pivot pin 46. Cooperating with the foregoing, control springs 79 affixed to adjacent tops of pivoting sections (shown particularly in FIG. 5) also exist to limit and/or bias full deployment, and serve as another source of potential energy to aid in actuation. It is known in the art to select appropriate spring strengths for items 20, 34 and 79 once the rest of the principles of the inventive shelter is made known. Thus, mechanical manual operation of the shelter is substantially aided through spring biasing each individual pivoting section, equally on each side and from top. Handles 80 at the edges of pivoting section allow the user to grasp as appropriate to deploy (close) the shelter. Unlike the prior art, mechanical manual actuation is easy.

Other features of the shelter include left bumper 24 and right bumper 38, positioned to act as a chock to engage wheels and prevent rearward collision of any vehicle during loading into the shelter, and to stabilize its position upon placement. Meanwhile, at the top slant edges of respective walls, left diverter 26 has left diverter lip 28, and right diverter 40 has right diverter lip 42. Like side gutters 62, these perform moisture diversion and abatement. Likewise, with reference to FIG. 7, respective pivoting sections have pivoting diverters 66 and pivoting diverter lips 68, each for the same purpose. Additionally, as can be shown in FIG. 5, base 10 comprises a slight downward slant, further encouraging efficient drainage and moisture abatement. Left shelf 18 and right shelf 32 comprise additional storage areas that can be activated and used, even when a vehicle occupies the shelter. Vents 48 allow air circulation during deployment.

Figure 7:
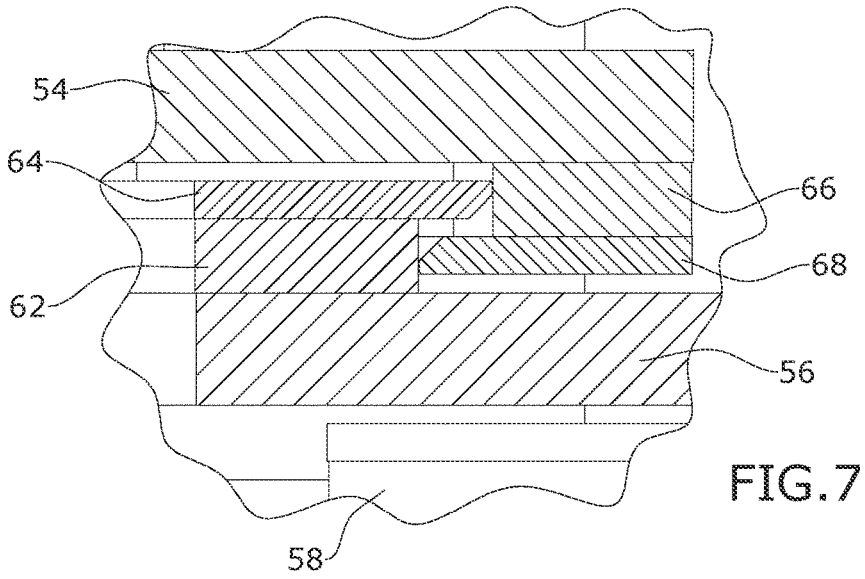
FIG. 7 is a detailed section view of the invention, taken along line 7-7 in FIG. 5.

As the view of FIG. 7 depicts, moisture abatement strategies cooperate together when the shelter is deployed. For example, where pivoting sections 54 and 56 are adjacent one another in a deployed state, therebetween, side gutter 62 and side gutter lip 64 of pivoting section 56 will lap with pivoting diverter 66 and pivoting diverter lip 68 of pivoting section 54. The rain diverter/gutter components incorporated into the garage channel rain that lands on the pivoting sections roofs to an area outside of the pitched floor. The floor stays dry. These same components also interlock the edges of the pivoting sections when the garage is closed to eliminate the possibility of prying them apart.

Figure 6:
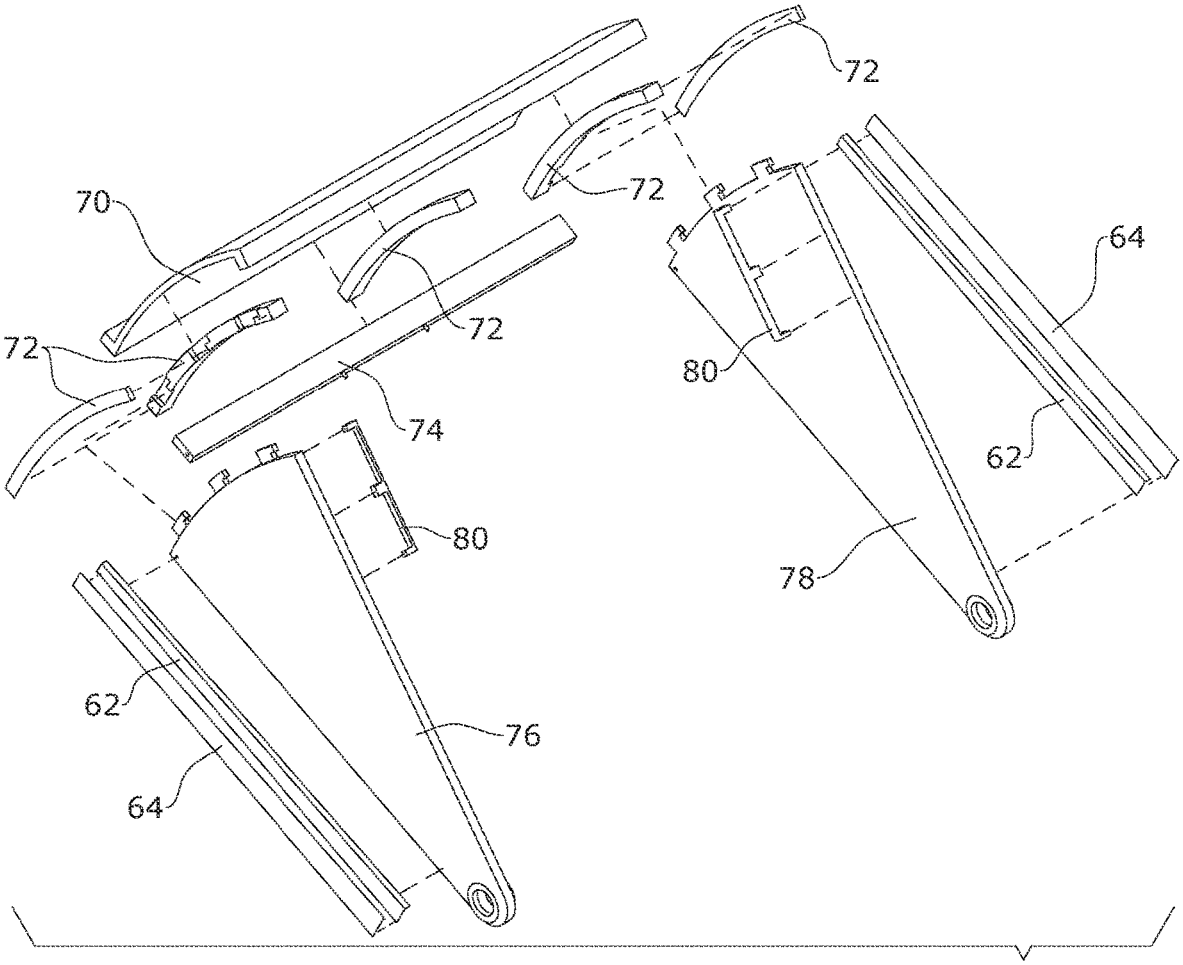
FIG. 6 is an exploded view of the fourth pivoting section.

With reference to FIG. 6, construction of pivoting section 60 is mostly representative of construction of the other pivoting sections, with the possible exception of handles 80 (only needed for the endmost section). A section roof 70 is strengthened by section roof braces 72, and further backed by the perpendicular attachment at the rear of section roof support 74 (already described). Hooks (or prongs) at the largest arcuate end of section sides 76 and 78 and recesses in braces 72, as shown in FIG. 6, may aid in construction and assembly. Indeed, any adjacent pieces of any structural part may be assembled together, as is known in the art, by fitting prongs into recesses, obtaining a secure fit thereby.

It will be appreciated that the stationary portion of the shelter is anchored in place and then the movable portions are attached to the stationary portion at the designated pivot point. After the shelter is assembled together, a vehicle to be stored would be parked on the base and the smallest pivoting segment would be moved from the nested position. When that first pivoting segment moves toward the "closed" position, it would in turn engage the next pivoting segment which when those two segments continue in that motion each movable segment would engage the next incremental segment until that first segment eventually makes contact with the base and the garage reaches the "closed" position. Opening the shelter would simply involve moving that first (smallest) segment towards the "open" position. As it moves in that direction, it would engage the next segment, and they would move together until they engaged the third section, and so on, until each incremental segment is fully nested again in the "open" position.

The retractable shell shelter could be manufactured using different kinds of rigid materials, such as metals, plastics, wood, or the like. However, because the movable sections would function best being made of a lightweight material, a plastic construction like many current day storage sheds would be ideal. A key design consideration is use of materials that will not break down after extended exposure to the elements. The retractable shell garage could be sold as a kit requiring assembly on site, or delivered to someone in a fully assembled condition. Many optional components could be added to enhance the shelter. A workbench, storage cabinet, electrical outlet, locking mechanism, light, automatic door opener, wheel stops, and a hose bib are only some of the possible options that could be added.

Although the invention has been explained in relation to its preferred embodiment, it is to be understood that many other possible modifications and variations can be made without departing from the spirit and scope of the invention as hereinafter claimed.

What is claimed is:

1. A nesting door shelter, comprising:

a base comprising a front and a rear;

a rear stationary portion at the rear of the base, comprising side walls, a rear wall and a roof;

a front nesting panel door, comprising at least two nesting panels and connectably engaged to the rear stationary portion, wherein each nesting panel is engaged with a respective biased engagement lever; and at least one lever in biased engagement with at least one nesting panel and configured to bias the at least one nesting panel toward a closed position, whereby stored potential energy aids in manual collapse and deployment of the front nesting panel door.

2. The nesting door shelter of claim 1, wherein bias created by each biased engagement lever is a spring bias.

3. The nesting door shelter of claim 2, wherein the spring bias is created by torsion springs.

4. The nesting door shelter of claim 3, wherein additional spring bias is provided by a control spring connecting adjacent panels.

* * * * *